US005154591A

United States Patent [19]

Guttinger

[11] Patent Number: 5,154,591

[45] Date of Patent: Oct. 13, 1992

[54] DISPLACEMENT MACHINE EMPLOYING A PLURALITY OF INTERMESHING SPIRAL DISPLACEMENT BODIES

[75] Inventor: Heinrich Guttinger, Wettingen, Switzerland

[73] Assignee: Aginfor AG fur industrielle Forschung, Wettingen, Switzerland

[21] Appl. No.: 718,565

[22] Filed: Jun. 20, 1991

[30] Foreign Application Priority Data

Jun. 20, 1990 [CH] Switzerland ..... 02047/90

[51] Int. Cl.[5] ..... F01C 1/04; F01C 11/00; F01C 17/06; F01C 19/08

[52] U.S. Cl. ..... 418/55.2; 418/55.3; 418/55.4; 418/55.5; 418/57; 418/59; 418/60; 418/178

[58] Field of Search ..... 418/55.2, 55.3, 55.4, 418/55.5, 58-60, 178, 57

[56] References Cited

U.S. PATENT DOCUMENTS 801,182 10/1905 Creux ..... 418/59
3,989,422 11/1976 Güttinger ..... 418/60

FOREIGN PATENT DOCUMENTS 174074 5/1905 Fed. Rep. of Germany .
2338825 3/1974 Fed. Rep. of Germany ..... 418/55.2
2603462 8/1976 Fed. Rep. of Germany .
3141525 5/1983 Fed. Rep. of Germany .
57-76202 5/1982 Japan ..... 418/60
61-197794 9/1986 Japan ..... 418/55.2
2115587 4/1990 Japan ..... 418/55.4
868187 5/1961 United Kingdom .

*Primary Examiner*—John J. Vrablik
*Attorney, Agent, or Firm*—Burns, Doane, Swecker & Mathis

[57] ABSTRACT

A displacement machine for compressible media includes a stationary housing, and a plurality of disks mounted for eccentric movement within the housing. Each of the disks has two symmetrically disposed spiral displacement bodies that are offset from one another by substantially 180° mounted on at least one side thereof so that the spiral displacement bodies move in an orbital fashion within the housing during operation. The disks are positioned with respect to one another such that each of the spiral displacement bodies intermeshes with another spiral distribution body to define pairs of cooperating spiral displacement bodies. The spiral displacement bodies have a curvature that is dimensioned such that opposed surfaces of cooperating spiral displacement bodies substantially contact one another at at least one sealing line that progresses continuously during operation. The cooperating spiral displacement bodies of each pair of cooperating spiral displacement bodies have a different wrap angle so that the spiral displacement body having the greater wrap angle has spiral portions lying radially inwardly and radially outwardly of the cooperating spiral displacement body.

12 Claims, 3 Drawing Sheets

DISPLACEMENT MACHINE EMPLOYING A PLURALITY OF INTERMESHING SPIRAL DISPLACEMENT BODIES

FIELD OF THE INVENTION

The invention relates to a displacement machine for compressible media and more particularly, to a displacement machine for compressible media in which a plurality of intermeshing spiral displacement bodies are disposed in an orbiting fashion within a stationary housing.

BACKGROUND OF THE INVENTION

Displacement machines of the spiral type are known for instance from U.S. Pat. No. 3,989,422. A compressor designed on this principle operates by virtually pulsation-free feeding of the gaseous operating medium, for instance air or an air/fuel mixture, and can, therefore, be advantageously used for charging internal combustion engines, as well as other purposes.

During the operation of such a compressor in accordance with a first embodiment, a plurality of approximately crescent-shaped work chambers are enclosed along a stationary feed chamber between the spiral, orbiting displacement bodies and the two peripheral walls of the feed chamber. These work chambers move from the inlet through the feed chamber to the outlet, in the course of which their volume is decreased continuously and the pressure of the operating medium is correspondingly increased. Good volumetric efficiency in such machines requires very precise manufacture. It has been found, for example, that the temperature differences that necessarily occur between stationary and orbiting spiral parts can have a disadvantageous effect.

In accordance with a second embodiment disclosed in the aforementioned patent, feeding of the operating medium proceeds similarly, but this embodiment is different in that rather than employing an orbiting motion of a displacement body in a stationary feed chamber, this second embodiment employs rotary motion of both intermeshing displacement bodies. This rotating spiral loader substantially comprises a housing in which is disposed two symmetrically designed displacement disks that are rotatable by means of drive elements. One of the two displacement disks is supported on a shaft journal. The second disk is secured so as to be fixed against relative rotation to a drive shaft. Rotation of the second disk causes the first disk to rotate in the same direction at the same rotary speed. Both disks execute a relative motion in the form of a circular displacement.

A machine of the type in which, unlike the above two types of machines, a plurality, in this case two, intermeshing spiral displacement bodies are disposed to orbit in a stationary housing, is generally known from German Letters Patent No. 174 074, issued as early as 1906. In this machine, however, the circular guidance of the disks which are mounted on a central drive and crankshaft and which are each equipped with one displacement body, is effected by a plurality of radially disposed outer crankshafts that are constrained in respect to one another and are supported by a rotatable frame.

OBJECT AND SUMMARY OF THE INVENTION

It is accordingly, an object of the present invention to create a displacement machine of the spiral type which combines the advantages of the two types of machines discussed above and which, moreover, has a smaller structural volume for the same feed quantity.

This as well as other advantageous objects can be attained by the present invention in that each disk, on at least one of its two sides, has two symmetrically disposed displacement bodies offset from one another by 180°, wherein the cooperating spiral displacement bodies of the two disks have a different wrap angle, such that the displacement body that acts as a feed chamber has both the radially outermost and the radially innermost spiral portion in the system and thus has the greater wrap angle.

One of the advantages associated with the present invention is that upon operation, the intermeshing displacement bodies are subjected to the same thermal and mechanical conditions so that heat differences are largely avoided within the active system. Furthermore, the version involving displacement bodies orbiting on all sides has the advantage over the conventional version, in which only one displacement body orbits in a stationary feed chamber, of doubling the length of the stroke and thus the feed quantity while the eccentricity remains the same. Moreover, because of the symmetrically embodied displacement bodies offset from one another by 180° on each disk, the machine runs quietly, since the disks along with the displacement bodies are statically and dynamically balanced as long as their center of gravity is located in the center.

It is particularly advantageous if two eccentric arrangements joined together in a constrained fashion are provided for driving and guiding the disks, the shafts of which arrangements are spaced apart and supported in the housing. It is also advantageous that the shafts be double eccentric shafts on which the disks to be driven are supported in their outer peripheral zones that are not occupied by the displacement bodies. The strains arising in the course of operation are distributed uniformly to the two eccentric arrangements and their bearings. Because the bearings are not exposed to the hot, compressed operating medium, the bearings need not be sealed off. Moreover, because two spaced-apart eccentric arrangements are provided, one of which is for instance drivable via a drive shaft, a statically defined support results, which furthermore assures compulsory guidance of the rotor except at the top and bottom dead centers of the disk position. To achieve unequivocal guidance in the dead centers of the disks as well, the double eccentric shafts supported in the housing are joined in a constrained fashion via a toothed belt drive.

BRIEF DESCRIPTION OF THE DRAWING FIGURES

The foregoing advantages as well as others will become apparent from the description of the present invention set forth below, considered in conjunction with the drawing figures in which like elements bear like reference numerals and wherein.

DETAILED DESCRIPTION OF THE PREFERRED EMBODIMENT

The following description sets forth those features of the present invention and the manner of operation of the present invention that are necessary for a proper understanding of the present invention. For a more detailed description of various other features of the displacement machine not specifically described below, reference is made to U.S. Pat. Nos. 3,989,422 and 801,182, the disclosures of which are hereby incorporated by reference.

Figure 2:
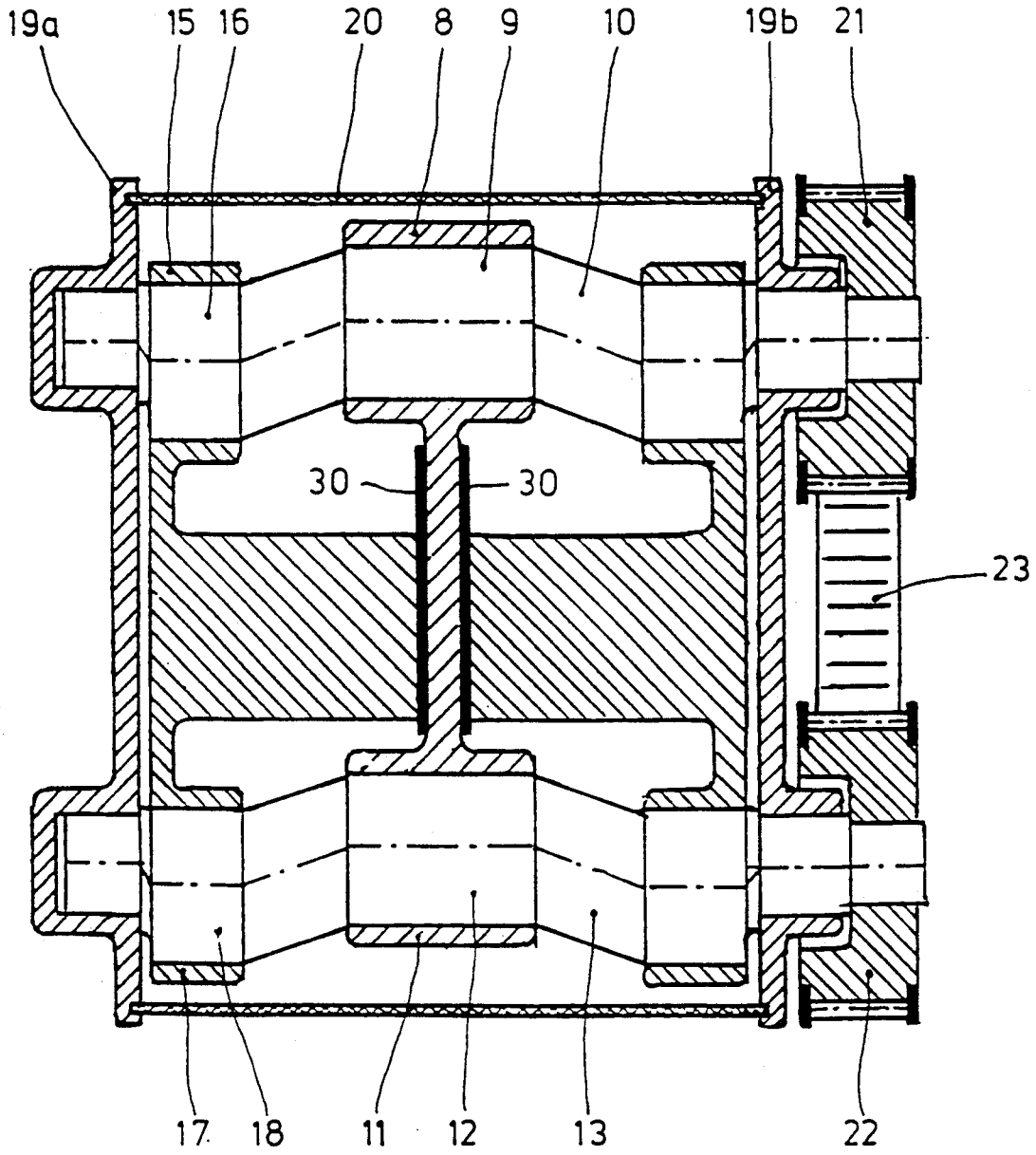
FIG. 2 is a longitudinal cross-sectional view through the displacement machine along the section line 2—2 in FIG. 1.
Figure 3:
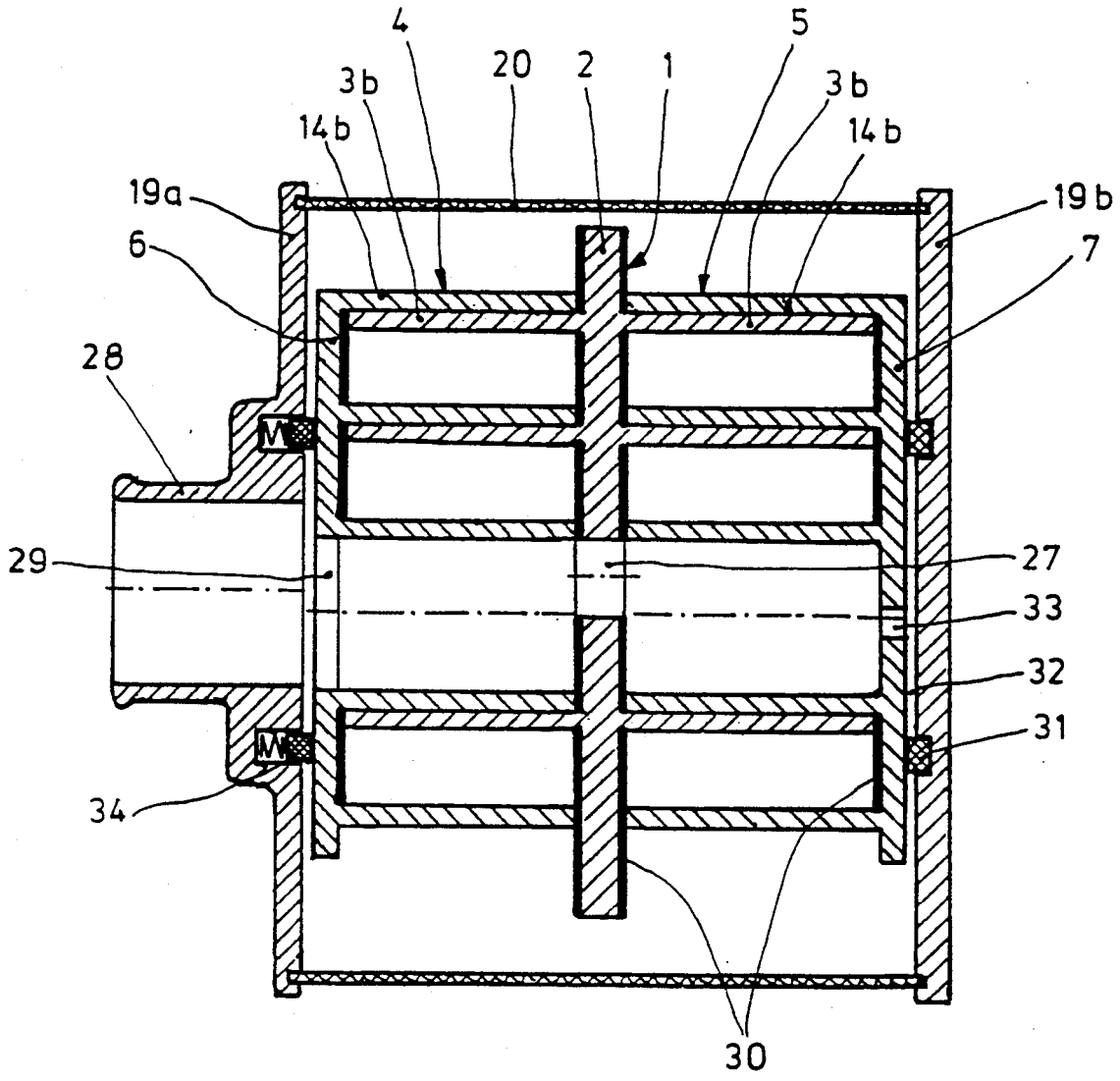
FIG. 3 is a longitudinal cross-sectional view through the displacement machine along the section line 3—3 in FIG. 1.

Referring initially to FIG. 2 and FIG. 3, it can be seen that the preferred embodiment shown is a machine with two parallel flows. This has the advantage that a common disk for both flows is provided with the operating elements of both the left and right flows (as shown in FIG. 3). With this configuration, not only one disk but support bearings as well can be dispensed with as will be explained in more detail hereinafter.

Figure 1:
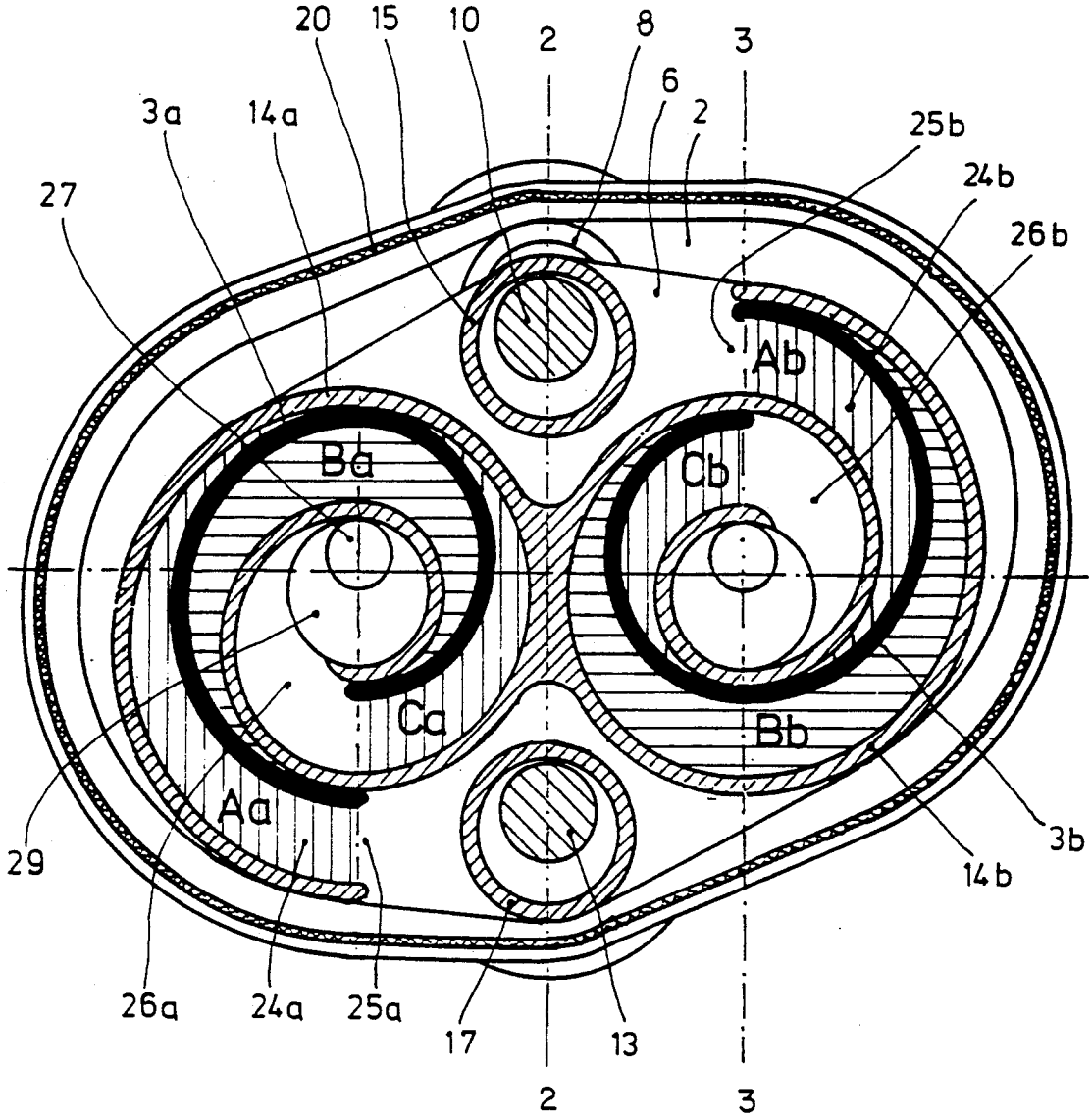
FIG. 1 is a cross-sectional view through the displacement machine in the plane of the feed chamber.

The overall middle rotor 1 of the machine employing the two-flow construction is illustrated in FIG. 1. Two spirally extending displacement bodies offset from one another by 180° are disposed on both sides of the machine disk 2. These bodies comprise spiral strips 3*a*, 3*b* which are retained vertically on the disk 2. The spiral strips themselves, as seen in FIG. 1, are formed of arcs of a circle adjoining one another and they encompass a wrap angle of 360°. These are the spiral strips shown as thick black lines in FIG. 1 which are disposed on the middle disk 2, only part of which can be seen. This is because for the sake of simplicity and better comprehension, the contours of the disks 6, 7 (which cannot be seen in the section of the drawing) of the two side rotors 4, 5 cooperating with the middle rotor are not shown in FIG. 1.

As can be seen, the spirals offset from one another by 180° are not nested within one another as in the known machines in order to form dual-pitch systems. Instead, the spirals are disposed centrally and symmetrically with respect to one another. Accordingly, they are independent, single-pitch spirals which have the advantage over the spirals that nest with one another in that with the same eccentricity they have twice the stroke and thus twice the feed capacity. From the standpoint of quiet operation, it is practical for the offset of the two spirals and their disposition on the disk to be such that the axis connecting the centers of the spirals intersects the axis connecting the centers of the drive and guide eccentrics, described hereinafter, at the center of gravity of the rotor 1.

A double eccentric system is provided for driving and guiding the rotor 1. Reference numeral 8 indicates a first hub, with which the disk 2 is slipped onto a roller bearing (not shown). This bearing is seated on an eccentric 9, which forms a part of a first double eccentric shaft 10. Reference numeral 11 indicates a second hub, with which the disk 2 is slipped onto a roller bearing (not shown). This bearing is seated on an eccentric 12, which forms a part of a second double eccentric shaft 13. The two hubs 8, 11 are disposed on the periphery of the disk 2 in the zones that are not occupied by the displacement bodies.

Unlike the middle or central rotor 1, the respective disks 6 and 7 on the two side rotors 4, 5 are provided on only one of their sides with two spirally extending displacement bodies, each offset from one another by 180°. These bodies comprise strips 14*a*, 14*b*, which are retained vertically on the disks 6, 7. In the embodiment shown in FIG. 1, these spirals are formed of a plurality of adjoining circular arcs (shown shaded). Naturally, these spiral strips 14*a*, 14*b* must have the same geometry as the strips 3*a*, 3*b* in order to be capable of cooperating with the strips 3*a*, 3*b*.

As with the middle rotor 1, the condition must be met that the offset of the two spirals 14*a*, 14*b* and their disposition on the disk be such that the axis connecting the centers of the spirals intersects the axis connecting the centers of the associated drive and guide eccentrics at the center of gravity of the respective disk 6, 7. Because of the spacing selected in the preferred embodiment between the spirals 14*a*, 14*b* offset by 180°, these spirals touch one another on their periphery over a certain distance, specifically at the geometrical point at which the center of gravity of the respective disks 6, 7 is located.

Unlike the spirals 3*a*, 3*b*, the spirals 14*a*, 14*b* encompass an angle of 720°. Viewed purely statically, it can thus be seen from FIG. 1 that the shaded spiral 14 actually forms a feed chamber for the thick black line spiral 3. For this reason, the spiral 14 must represent the radially outermost portion at the entry to the spiral system, and logically the radially innermost portion at the outlet of the spiral system as well. Only in this way can the spiral 14 completely encompass the inner spiral 3 on the occasion of the orbital motion. Thus, this explains the different wrap angles. Both the adjoining inner parts of the two spirals 14*a*, 14*b* and the outer parts adjoining them have an S shape. As a result of this disposition, vibration of the column of air upon entry into the spirals is prevented.

For driving and guiding the rotors 4, 5, the same double eccentric system already mentioned is provided. Thus reference numeral 15 indicates the hubs with which the disks 6, 7 are seated via roller bearings (not shown) on eccentrics 16 of the first double eccentric shaft 10. Reference numeral 17 indicates the hubs via which the disks 6, 7 are supported on eccentrics 18 of the second double eccentric shaft 13. Once again, the two hubs 15, 17 are disposed on the periphery of the disks 6 and 7 in the zones that are not occupied by the displacement bodies. The two eccentrics 16, 18 are offset from the two eccentrics 9, 12 by 180°.

With the construction of the machine according to the present invention, the load is distributed uniformly to the two double eccentric shafts 10, 13. The bearing arrangement outside the spirals has the extraordinary advantage that on the one hand there is no impairment of the dimensions of the bearings by any space restrictions and on the other hand, because of the disposition on the cold side (where the ambient air is aspirated), permanently lubricated bearings can be used. Thus, bearing seals, which as a rule are expensive, also become unnecessary. Even if oil-lubricated slide bearings are used, in which oil would emerge at the side and get into the region of the spiral inlets 25*a*, 25*b*, described in more detail below, this would not impair oil-free feeding of the operating medium. In contrast to the known machines employing a stationary feed chamber and displacement bodies orbiting therein, in which the orbiting displacement mechanism aspirates a fog of oil present at the inlet into the spiral, the present invention is such that any oil is centrifugally removed by the orbiting positive displacement mechanisms.

The two double eccentric shafts 10, 13 are supported in a conventional manner in the two lateral housings halves 19*a*, 19*b*. The two lateral housings halves 19*a*, 19*b* are joined together via fasteners (not shown) on their periphery on a housing jacket 20.

Since this jacket 20 is not exposed to any heavy strain, because on both sides (inside and outside) it is merely acted upon by atmospheric pressure, it need not be dimensioned as anything heavier than a simple outer skin.

Accordingly, the two spaced-apart eccentric arrangements 9, 10, 16 and 12, 13, 18 provide the drive and guidance of the rotors 1, 4 and 5. To this end, the two shafts 10, 13 penetrate one of the lateral housing halves 19*b*. At the protruding ends, the shafts 10, 13 are each provided with a respective toothed-belt pulley 21, 22. The two toothed-belt pulleys 21, 22 are located in the same vertical plane. It is to be understood that only one of the two shafts needs to be connected to a drive mechanism. To attain unequivocal guidance of the rotors at the dead center points during orbital motion, the two eccentric arrangements are synchronized to accurate angles. This is done here, in functional coincidence with the actual drive, via a toothed belt 23. The toothed belt drive 23 may also be embodied as a belt tightener.

If the aforementioned definition of the feed chamber is used for better comprehension, then the two feed chambers offset from one another by 180° can be indicated as 24*a* and 24*b* in FIG. 1. They each extend from one inlet 25*a*, 25*b* formed on the outer periphery of the spiral 14*a*, 14*b* to an outlet 26*a*, 26*b* provided in the interior of the spiral. The displacement bodies or strips 3*a*, 3*b* engage these feed chambers 24*a*, 24*b* and their curvature is dimensioned such that the strips touch the inner and outer defining walls of the respective feed chamber at a plurality of points, for instance at two points each.

In operation, the double eccentric drive mechanism assures that all the points of the rotor and thus all the points of the spiral displacement bodies execute a circular displacement motion. Because of the multiple alternating approaches of the displacement bodies of the middle rotor and those of the side rotors, crescent-shaped work chambers that enclose the operating medium are created between the intermeshing strips. During the drive of the rotor disks, these work chambers are displaced in the direction of the outlet by the feed chambers formed by the strips. The volumes of these work chambers decrease in this process and the pressure of the operating medium is correspondingly increased.

It can be readily seen from FIG. 1 that with the spiral position shown, the outer part Aa (shaded vertically) of the left feed chamber 24*a* which opens toward the inlet 25*a* has a larger surface area than the inner part Ab of the right feed chamber 24*b* which opens toward the inlet 25*b*. It can also be seen that the outer part Ca (also vertically shaded) of the left feed chamber 24*a* which opens toward the outlet 26*a* has a larger surface area than the inner part Cb of the right feed chamber 24*b* which opens toward the outlet 26*b*. Contrarily, the enclosed, crescent-shaped inner part Ba (shaded horizontally) of the left feed chamber 24*b* has a markedly smaller surface area than the enclosed, crescent-shaped outer part Bb of the right feed chamber 24*b*. The sum of the areas Aa+Ba+Ca, however, is equal to the sum of the areas Ab+Bb+Cb. Thus, since the same volume is fed at any time in the left and right feed chambers 24*a* and 24*b*, respectively, regardless of the spiral position, this leads to the aforementioned freedom from vibration during operation.

An opening 27 is provided on each of the two inner spiral ends in the middle disk 2 so that the medium can pass from one side of the disk 2 to the other, or in other words from the right flow to the left flow in the case shown, so as to be removed in a central outlet 28 (FIG. 3) disposed on only one side. The disk 6 of the left rotor is also provided with a central opening 29. This opening 29 requires that provisions be made for sealing off the disk 6 from the adjacent lateral housing part 19*a* to avoid short-circuiting the spiral outlet with the spiral inlet.

In this type of machine, the sealing problem is extraordinarily important. It will be understood that for proper functioning and operation, not only is radial sealing of the strips 3*a*, 3*b* with respect to the strips 14*a*, 14*b*, or in other words the closure of the feed chambers 24*a*, 24*b* in the circumferential direction, important, but in addition, the axial tightness of the feed chambers is significant. Thus, the spiral strips of one rotor must rest with their face ends on the disks of the respective cooperating opposite rotor. Sealing is done with the aid of actual lubricating films 30 (FIGS. 2 and 3), for example PTFE, which are applied by suitable means at the necessary points to the sides of the disks, and preferably only at those points.

Since, in operation, the pressure which increases toward the interior of the spiral has the tendency to press the cooperating rotors apart, provisions to counteract this should be made. Sealing the side rotor 5 from the housing half 19*b* is thus first effected via a stationary slide seal 31. This seal 31, designed as a ring, is placed in a suitable groove in the housing half 19*b* and thus does not undergo translational motion. The chamber 32 inside the ring 31 is acted upon by the pressure of the operating medium at the outlet which reaches the back of the disk 7 via a bore 33 in this disk. Outside the ring 31, the pressure that prevails in the inlet, in other words atmospheric pressure, prevails on the back of the disk 7. It can thus be appreciated that simply by dimensioning the annular diameter of the seal 31 and thus the active disk area, a simple means is available for defining, on the one hand, the pressing force of the strips against the corresponding disks and, on the other hand, the pressing force of the disks against the stationary walls. Friction and thus wear can, as a result, be optimized. It can also be readily appreciated that in this design, the wear at the face ends of the strips is automatically balanced.

The foregoing also applies to the left side of the machine at which the outlet 28 is located. A provision must be made, however, so that in the pressure-free state as well as when the machine starts up, the axial tightness of the feed chambers is assured. This is because pneumatic sealing is not possible in such a state. This provision may, for example, be a spring-reinforced slide ring 34 which is additionally configured such that it seals off the outlet side from the inlet side. In that case, the spring furnishes the necessary pressing force to keep the side rotor 4 operatively connected with the middle rotor 1, the middle rotor operatively connected with the side rotor 5, and the side rotor 5 operatively connected with the housing half 19.

While this invention has been described and illustrated in accordance with a preferred embodiment, it is recognized that changes and variations may be made and equivalents employed herein without departing from the invention as set forth in the claims.

What is claimed is:

1. A displacement machine for compressible media, comprising: a stationary housing; and a plurality of disks mounted for eccentric movement within the housing, each of said disks having two symmetrically disposed spiral displacement bodies that are offset from one another by substantially 180° mounted on at least one side thereof so that said spiral displacement bodies move in an orbital fashion within the housing during operation, the two spiral displacement bodies that are mounted on one of the disks being disposed in mirror symmetry with respect to one another and having spiral centers that are offset with respect to one another, each of the two displacement bodies mounted on said one disk having a center, an axis connecting the centers of the two displacement bodies on said one disk passing through a center of gravity of the said one disk, said disks being positioned with respect to one another such that each of the spiral displacement bodies intermeshes with another spiral displacement body to define pairs of cooperating spiral displacement bodies, the cooperating displacement bodies forming independent single-pitch spiral systems, the spiral displacement bodies having a curvature that is dimensioned such that opposed surfaces of cooperating spiral displacement bodies substantially contact one another at at least one sealing line that progresses continuously during operation, the cooperating spiral displacement bodies of each pair of cooperating spiral displacement bodies having a different wrap angle.

2. The displacement machine according to claim 1, wherein each of said spiral displacement bodies has a free end face, the free end face of each displacement body contacting the side of the disk from which extends the cooperating displacement body, the side of each disk which contacts the free end face of one of the displacement bodies being provided with a film at points of contact with the displacement bodies to ensure axial sealing.

3. The displacement machine according to claim 1, wherein said plurality of disks are mounted on two spaced apart double eccentric shafts joined together in a constrained manner and positioned in the housing, said plurality of disks having outer peripheral zones that are not occupied by the displacement bodies and said disks being mounted on said outer peripheral zones, at least one of the double eccentric shafts being adapted to drive the disks.

4. The displacement machine according to claim 3, wherein said disks are mounted on only two double eccentric shafts.

5. A displacement machine for compressible media, comprising: a stationary housing; a middle disk mounted for eccentric movement within the housing; and two side disks mounted for eccentric movement within the housing, one of said side disks being mounted on each side of said middle disk, said middle disk having two symmetrically disposed spiral displacement bodies mounted on both sides thereof that are offset substantially 180° from one another, the two displacement bodies mounted on each side of the middle disk being disposed in mirror symmetry with respect to one another and having spiral centers that are offset with respect to one another, the two displacement bodies mounted on each side of the middle disk having a center, an axis connecting the centers of the two displacement bodies mounted on each side of the middle disk passing through a center of gravity of the middle disk, each side disk having two symmetrically disposed spiral displacement bodies mounted on one side thereof that are offset substantially 180° from one another, the spiral displacement bodies mounted on one side disk intermeshing and cooperating with the displacement bodies mounted on one side of the middle disk and the displacement bodies mounted on the other side disk intermeshing and cooperating with the displacement bodies mounted on the opposite side of the middle disk so that the cooperating displacement bodies form independent single-pitch spiral systems and so that during operation each point of a displacement body executes a circular displacement motion, the spiral displacement bodies having a curvature that is dimensioned such that opposed surfaces of cooperating spiral displacement bodies substantially contact one another at at least one sealing line that progresses continuously during operation, the cooperating spiral displacement bodies each having a different wrap angle such that the spiral displacement body having the greater wrap angle defines a feed chamber and has spiral portions lying radially inwardly and radially outwardly of the cooperating spiral displacement body.

6. The displacement machine according to claim 5, wherein each of said spiral displacement bodies has a free end face, the free end face of each displacement body contacting the side of the disk from which extends the cooperating displacement body, the side of each disk which contacts the free end face of one of the displacement bodies being provided with a film at points of contact with the displacement bodies to ensure axial sealing.

7. The displacement machine according to claim 5, wherein said middle disk and said side disks are mounted on two spaced apart double eccentric shafts positioned in the housing, said middle disk and said side disks being joined together in a constrained manner and having outer peripheral zones that are not occupied by the displacement bodies, said disks being mounted on said outer peripheral zones, and at least one of the double eccentric shafts being adapted to drive the disks.

8. The displacement machine according to claim 7, wherein one end of each double eccentric shaft extends through the same housing half and is connected to a respective toothed member, the toothed member connected to one of the double eccentric shafts being connected to the toothed member connected to the other double eccentric shaft by way of a toothed drive.

9. The displacement machine according to claim 7, wherein said disks are mounted on only two double eccentric shafts.

10. The displacement machine according to claim 7, wherein said double eccentric shafts are supported within the housing on oppositely positioned housing halves.

11. The displacement machine according to claim 10, including a sealing ring positioned between facing surfaces of one of the housing halves and one of the side disks.

12. The displacement machine according to claim 10, including a central outlet provided on one of said housing halves, one of said side disks being provided with a central opening that communicates with the central opening in said one housing half, and said middle disk being provided with an opening extending therethrough to permit the media to pass between opposite sides of the middle disk.

* * * * *